United States Patent [19]

Brechbühler

[11] Patent Number: 4,549,384

[45] Date of Patent: Oct. 29, 1985

[54] REINFORCING ROD HOLDER FOR USE IN CONNECTION-TYPE CONCRETE POURING OPERATIONS AND A METHOD OF PRODUCING SAME

[75] Inventor: Fritz Brechbühler, Gümligen, Switzerland

[73] Assignee: Pebea N.V., Willemstad, Netherlands Antilles

[21] Appl. No.: 523,620

[22] Filed: Aug. 16, 1983

[30] Foreign Application Priority Data

Sep. 10, 1982 [EP] European Pat. Off. ..... 82810378.8

[51] Int. Cl.[4] ..... E04B 1/41; E04C 1/00

[52] U.S. Cl. ..... 52/704; 52/378; 52/698; 52/712

[58] Field of Search ..... 52/378, 309.16, 699, 52/698, 700, 712, 713, 701, 704, 710; 249/188, 190

[56] References Cited

U.S. PATENT DOCUMENTS

| | | | |
|---|---|---|---|
| 1,715,743 | 6/1929 | Duggan | 52/712 X |
| 2,780,936 | 2/1957 | Hillberg | 52/699 X |
| 3,430,408 | 3/1969 | Dean | 52/699 |
| 3,884,004 | 5/1975 | Douma et al. | 52/699 X |
| 4,010,586 | 3/1977 | Brechbuhler . | |
| 4,325,533 | 4/1982 | Tiletschke et al. | 249/188 |
| 4,329,825 | 5/1982 | Zehtner | 52/704 X |
| 4,338,757 | 7/1982 | Witschi et al. | 52/712 |
| 4,419,852 | 12/1983 | Dietrich | 52/699 X |
| 4,468,907 | 9/1984 | Tiletschke et al. | 52/378 X |

FOREIGN PATENT DOCUMENTS

| | | |
|---|---|---|
| 0026803 | 4/1981 | European Pat. Off. . |
| 1684196 | 4/1971 | Fed. Rep. of Germany . |
| 81044690 | 2/1981 | Fed. Rep. of Germany . |

*Primary Examiner*—Donald G. Kelly
*Assistant Examiner*—Richard Chilcot, Jr.
*Attorney, Agent, or Firm*—Wender Murase & White

[57] ABSTRACT

The reinforcing rod holder includes a hollow body (1) having a depression in which the downwardly bent reinforcing rods (2) are inserted in such a manner that their U-shaped anchoring portions protrude. The free end (3 and 4) of the reinforcing rods are disposed entirely in the hollow body, together with the bend portion. To permit insertion of the anchoring portions, the hollow body is provided with apertures (5), and holes (6) having a diameter which is approximately identical to the diameter of the reinforcing rods are provided at the two ends of such apertures (5), while the central portion of the apertures is sealed by two overlapping flaps (7). The hollow body is further provided with mounting or support ribs (8) at the apertures (5) and two spacer ribs (9 and 10) between the last three apertures (5) in order to serve as support faces for the ends of the reinforcing rods. The hollow body, containing the reinforcing rods, is filled with expanded plastic material. A reinforcing rod holder of this type is used in connection-type concreting operations and is advantageous in that, on the one hand, the portions of the reinforcing rods not embedded in concrete are packed in expanded plastics material and therefore cannot rust and, on the other hand, the expanded plastics material can be completely and conveniently removed by extracting the hollow body when the connection-type concreting operation is being carried out. In addition, the hollow body actually serves as a mould, thereby ensuring that the reinforcing rod holder is produced rationally and cheaply.

8 Claims, 4 Drawing Figures

E1
E2
E3
E4
E5
E6
E7
E8
1
2
3
4
5
8
9
10
III
IV

E1
E2
E4
1
2
4
6
7
8
12

REINFORCING ROD HOLDER FOR USE IN CONNECTION-TYPE CONCRETE POURING OPERATIONS AND A METHOD OF PRODUCING SAME

BACKGROUND OF THE INVENTION

1. Field of the Invention

The present invention relates to a holder for reinforcing rods of iron or steel for use in connection-type concreting operations, including a hollow body having a depression which accommodates the free, downwardly bent ends of the reinforcing rods provided with a U-shaped clamping member, such ends converging in relation to the centre line of the hollow body, and the present invention also relates to a method of producing such a reinforcing rod holder.

2. Prior Art

A holder for reinforcing rods for concrete of this type is disclosed in U.S. Pat. No. 4,329,825 wherein the holder is advantageous in that the reinforcing rods disposed therein are almost completely protected, and the holders can easily be transported. The portion of the holder at the wall side is provided with equidistant transverse grooves and has markings for holes which are to be subsequently bored. The U-shaped, downwardly bent shank ends of the reinforcing rods are hooked into such holes, and a cover member is mounted thereafter. It is a relatively labour-intensive operation to hook-in the reinforcing rods, and such an operation is almost impossible to automate or can only be automated with great difficulty. Moreover, measures must be taken to secure the reinforcing rods in a quite specific position. In addition, the cover member is, more properly speaking, a member which needs to be injected, and it is difficult to seal it completely.

The Applicant's U.S. Pat. No. 4,010,586 also discloses a reinforcing rod which essentially comprises a prismatic, expanded plastic material body which retains the reinforcing rods. When such holder is only comprised of expanded plastics material, and with the versatile, ever-increasing application of this first reinforcing rod holder, it has proved desirable, on the one hand, to facilitate the complete removal of the expanded plastics material body and to improve its stability and, on the other hand, to improve the method of producing the reinforcing rod holder.

SUMMARY OF THE INVENTION

The present invention seeks, therefore, to provide a reinforcing rod holder which can be produced more economically and where all the parts of the holder can be readily and completely removed.

According to the present invention there is provided a reinforcing rod holder for use in connection-type concreting operations, comprising a hollow body having a depression therein which accommodates the free ends of the reinforcing rods which rods also each have a U-shaped anchoring portion, such ends converging in relation to the center line of the hollow body, wherein the hollow body containing the ends of the reinforcing rods is filled with expanded plastic material.

Also according to the present invention there is provided a method of producing the reinforcing rod holder in which the anchoring portions of the reinforcing rods are inserted through apertures in the hollow body depression from the open side, and the depression containing the ends of the reinforcing rods is subsequently filled with plastics material by a molding process selected from the group consisting of injection, casting and pouring with the hollow body serving as a mold.

DETAILED DESCRIPTION OF THE INVENTION

Figure 1:
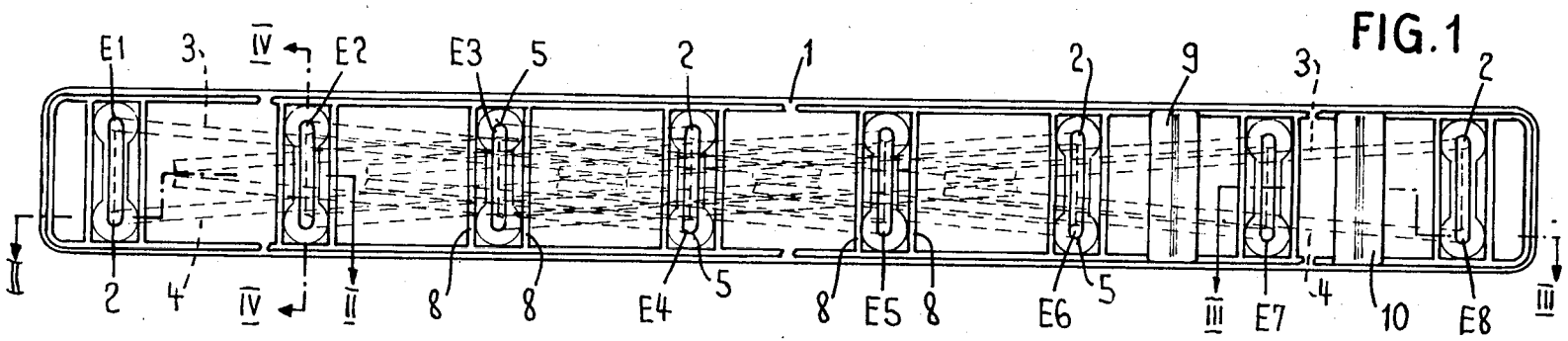
FIG. 1 is a plan view of a reinforcing rod holder according to the invention.

FIG. 1 illustrates a hollow body 1 made of plastic material and having a depression therein and steel reinforcing irons or rods 2 which, in the present case, include a U-shaped clamping or anchoring portion and are bent downwardly, the free ends 3 and 4 of such reinforcing rods 2 being convergent. The hollow body 1 has slots or like elongate apertures 5 formed therein, and the anchoring portion of each reinforcing rod is inserted through one such aperture 5 from behind. Holes 6 are provided at both ends of these apertures 5 in order to accommodate the shanks of the reinforcing rods, which holes are of slightly less diameter than the shanks, while the central portion of these apertures 5 is formed from two overlapping flaps or lugs 7 which re-seal the aperture around after the reinforcing rods cross section after they have been inserted therein. In addition, these lugs securely retain the reinforcing rods.

At both ends of the apertures 5, the hollow body is further provided with mounting or support ribs 8 which serve to support the lowermost position of the downwardly bent shanks of the reinforcing rods. In the present case (see FIG. 1), this situation applies to the first three reinforcing rods E1, E2 and E3 as seen from the left. The other five reinforcing rods are inserted in the opposite direction, i.e. in FIG. 1, the free ends point to the left. The downwardly bent shanks of the rods E4, E5 and E6, numbered from the left, rest on the downwardly bent shanks of the rods E1, E2 and E3 (see also FIG. 2). In order to prevent the reinforcing rods E7 and E8 from tilting, two spacer ribs 9 and 10 are provided between the last three apertures and support the downwardly bent shanks of the reinforcing rods E7 and E8.

Figure 2:
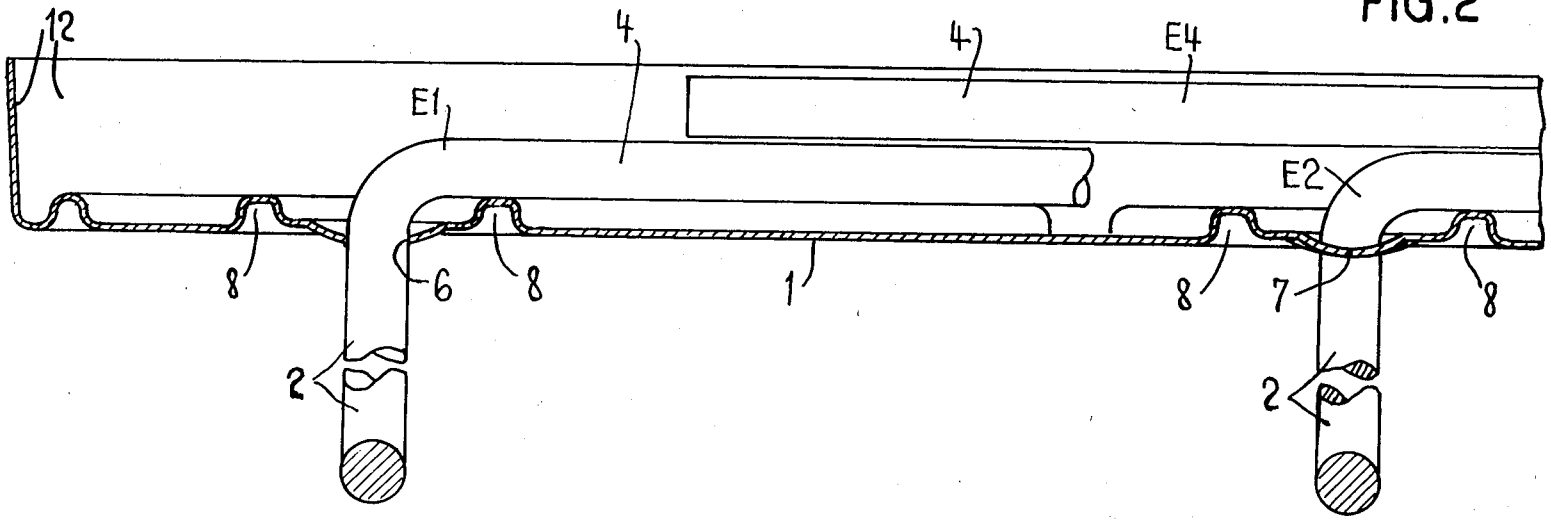
FIG. 2 is an enlarged, detailed, longitudinal sectional view taken along the line II—II of FIG. 1.
Figure 3:
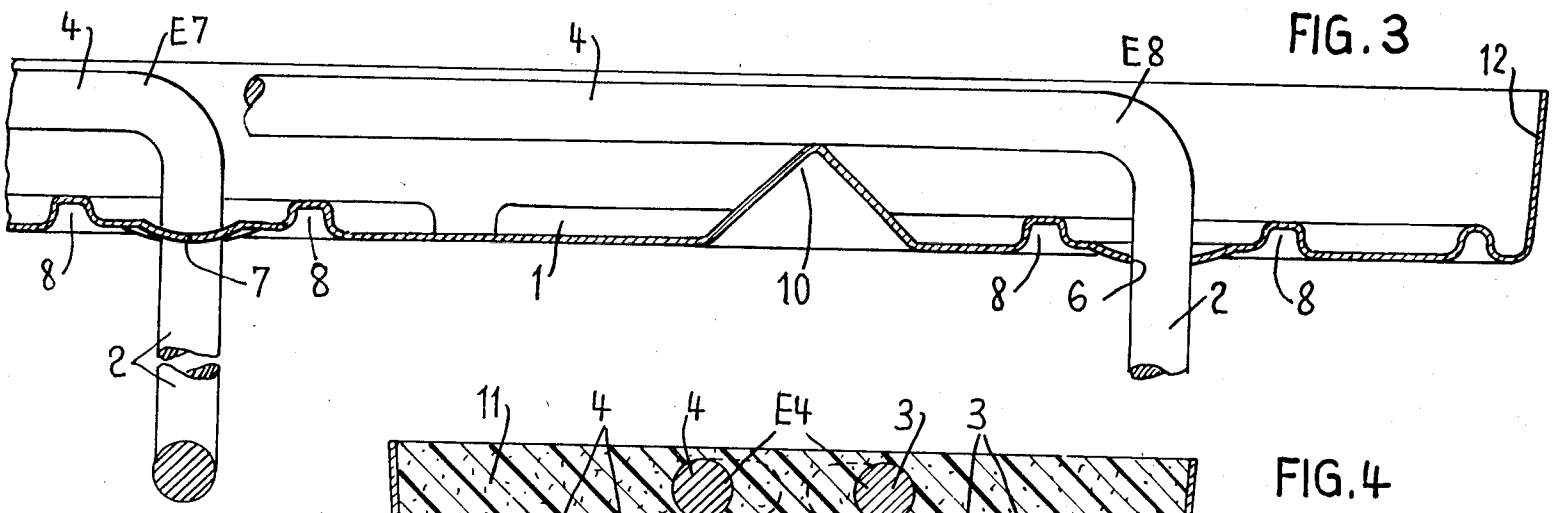
FIG. 3 is an enlarged, detailed, longitudinal sectional view taken along the line III—III of FIG. 1.

As is especially apparent in FIGS. 2 and 3, the downwardly bent ends, together with the bend portion, are disposed in the hollow body, and it is thereby ensured that, when the connecting rods are used, such connecting rods can be bent-back completely in a straight line.

Figure 4:
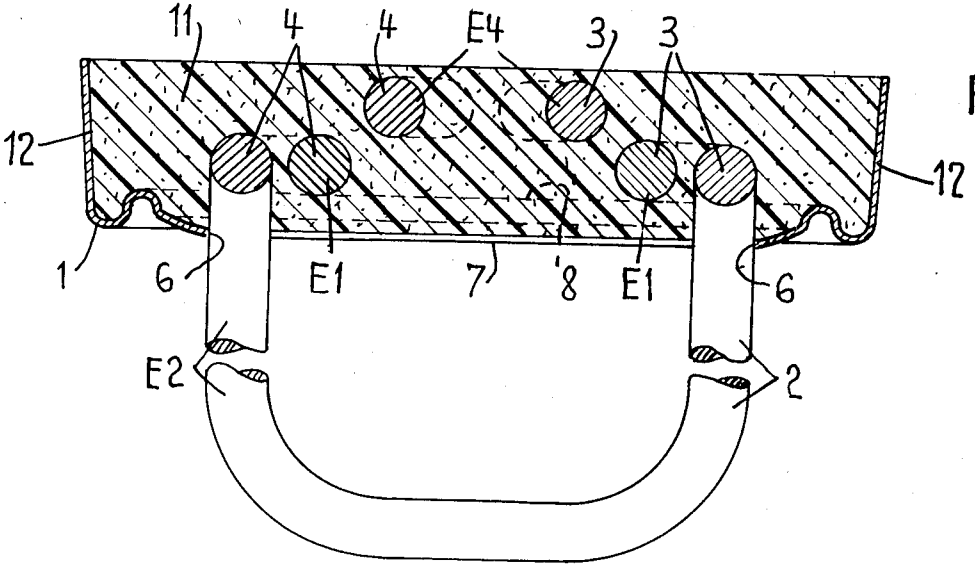
FIG. 4 is an enlarged, sectional view taken along the line IV—IV of FIG. 1.

In contrast to the arrangement as claimed in U.S. Pat. No. 4,010,576 because and other similar arrangements, the holow body is not provided with a cover member which, in part, is very complicated and expensive to produce and presents the risk of concrete or concrete emulsion entering the hollow body, whereby the reinforcing rods may rust. Instead, the hollow body of the present invention is filled with an expanded plastics material 11 (FIG. 4). It will be apparent that, with this simple solution, the hollow body 1 may be used as an injection mould, a casting mould or a pouring mould, thereby permitting the production method to be substantially simplified compared with the method as claimed in Swiss PS No. 562 376, since a special mould needs to be produced and used to utilize that disclosed method. It is advantageous for the shanks of the reinforcing rods to be provided with only enough expanded plastic material so that they are well covered but still show or gleam-through in order to facilitate removal of the holder means.

The straight portions can easily be inserted through the apertures 5, and such an operation is suitable for semi-automatic or fully automatic procedures, while the overlapping flaps or lugs 7 ensure that the rods remain in place. The subsequent injection of expanded plastic material is also a very simple process and can be accomplished very economically. The straight portions and ends of the reinforcing rods are embedded, thereby ensuring that they do not rust. Polyurethane is an example of a suitable expanded plastic material. Moreover, it is also possible to use Styroper or any other suitable plastic material which can be injected, cast or poured.

When the reinforcing rods are embedded in concrete, a temporary plastering is occasionally applied to the wall, and such plastering can adhere well to expanded plastic material. In contrast thereto, it is advantageous to ensure that the concrete cannot adhere well to the other parts of the present holder, and this can be accomplished either by appropriately selecting the plastic material or by spraying an appropriate substance onto the outer surface thereof.

To achieve their purpose, the bent ends of the reinforcing rods are exposed and disposed in a straight line, so that a large portion of the expanded plastic material can be regarded as already removed. Afterwards, the hollow body (which does not adhere well to the concrete) is removed from the rods when the anchoring portions are embedded and this may be achieved by means of a suitable tool, thereby also bringing with the body the last remains of the expanded plastic material, leaving the reinforcing rods completely exposed, as well as the the wall surface at the place where the hollow body rested prior thereto. In order to facilitate this extraction of the hollow body, the lateral walls 12 of the hollow body are slightly inclined outwardly in the direction of the open end. It is also easy to visualise that both the support ribs 8 and the two spacer ribs 9 and 10 will leave behind an impression in the concrete wall, and such an impression will serve to define in effect an additional indentation.

Instead of using identically-shanked reinforcing rods, as is described in this example, it is also feasible to use reinforcing rods having only one shank and one clamping or anchoring portion. Instead of using a hollow body made of plastic material, it is also possible to use a hollow body made from a thin metal foil.

It is to be appreciated that the preferred embodiment is described by way of example although it is to be appreciated that various modifications, variations and changes may be effected without departing from the spirit and scope of the appended claims.

I claim:

1. A reinforcing rod holder for holding reinforcing rods having an anchor portion and at least one rod end comprising:

a hollow body portion having a depression and a plurality of apertures therethrough in communication with said depression for receipt of the rod ends in said depression through said apertures so that the anchor portions project away from said body portion; and a filled-in-place, hardenable material cooperating with said body portion and the reinforcing rods by filing said depression and embedding the rod ends therein, so that said body portion, said material and the reinforcing rods form a unitized, self-supporting structure.

2. The reinforcing rod holder as recited in claim 1, wherein the reinforcing rod has a U-shaped anchor portion and a pair of rod ends each having an equal length shank disposed perpendicularly to the U-shaped portion, the shanks converging relative to each other, and disposed within said body portion.

3. The reinforcing rod holder as recited in claim 1 wherein said apertures each have a pair of opposed, overlapping flaps defining a hole therebetween.

4. The reinforcing rod holder as recited in claim 1 wherein said body has first and second body ends, at least one support rib projecting from said body proximate said first body end and into said depression having a first height and at least one spacer rib projecting from said body proximate said second body end into said depression having a second height greater than said first height.

5. A reinforcing rod holder as recited in claim 1 wherein said body portion has a base wall having said apertures and at least one lateral wall inclined outwardly away from said base wall.

6. The reinforcing rod holder as recited in claim 1 wherein said material is plastic.

7. The reinforcing rod holder as recited in claim 6 wherein said plastic is polyurethane.

8. The reinforcing rod holder as recited in claim 6 wherein said plastic material is styropor.

* * * * *